US005896979A

United States Patent [19]

Hokari et al.

[11] Patent Number: 5,896,979

[45] Date of Patent: Apr. 27, 1999

[54] ENDLESS BELT TYPE DELIVERY DEVICE

[75] Inventors: Norio Hokari; Shuji Iseki; Junichirou Sameshima; Yukio Hayashi; Ryoichi Tsuruoka; Mikio Kobayashi, all of Ebina, Japan

[73] Assignee: Fuji Xerox Co., Ltd., Tokyo, Japan

[21] Appl. No.: 08/732,982

[22] Filed: Oct. 16, 1996

[30] Foreign Application Priority Data

Oct. 19, 1995 [JP] Japan ..... 7-271486
Oct. 20, 1995 [JP] Japan ..... 7-273125

[51] Int. Cl.[6] ..... B65G 39/16

[52] U.S. Cl. ..... 198/807; 198/814; 198/806

[58] Field of Search ..... 198/806, 807, 198/814

[56] References Cited

U.S. PATENT DOCUMENTS

| | | | |
|---|---|---|---|
| 3,621,987 | 11/1971 | Sherwood | 198/807 |
| 4,174,171 | 11/1979 | Hamaker et al. | 198/806 X |
| 4,369,617 | 1/1983 | Hanaway et al. | 198/814 X |
| 4,421,228 | 12/1983 | Marsigilo et al. | 198/814 |

FOREIGN PATENT DOCUMENTS

| | | | |
|---|---|---|---|
| A-54-24033 | 2/1979 | Japan . | |
| 60-71407 | 4/1985 | Japan | 198/807 |
| A-4-60915 | 2/1992 | Japan . | |
| 4-159911 | 6/1992 | Japan | 198/807 |
| U-4-87849 | 7/1992 | Japan . | |
| A-4-31796 | 11/1992 | Japan . | |
| A-5-165385 | 7/1993 | Japan . | |
| 583046 | 12/1977 | U.S.S.R. | 198/814 |

*Primary Examiner*—James R. Bidwell
*Attorney, Agent, or Firm*—Oliff & Berridge, PLC

[57] ABSTRACT

An endless belt type delivery device includes a drive roller, a plurality of driven rollers including a tension apply roller disposed in such a manner that the respective axial directions of the rollers are set parallel to each other, an endless belt wound around the respective rollers in such a manner that the endless can be driven by rotating the drive roller, and meandering adjusting means, provided in at least two of the above-mentioned rollers, for biasing contact pressures between the two or more rollers and the endless belt toward the axial-direction end portions of the rollers. The contact pressure between the rollers and the endless belt are biased in the opposite direction to the meandering direction of the endless belt by the meandering adjusting means, thereby being able to correct the meandering of the endless belt.

21 Claims, 14 Drawing Sheets

ENDLESS BELT TYPE DELIVERY DEVICE

BACKGROUND OF THE INVENTION a). Field of the Invention

The present invention relates an endless belt type delivery device employed in a transfer unit of a conveyor belt type which is incorporated in an image forming apparatus such as a copying machine, a printer or the like and also which carries a sheet by means of a belt and allows a toner image to be transferred onto the sheet.

b). Related Art

The above-mentioned image forming apparatus comprises, in the periphery of an image carrier, a latent image forming unit, a developing unit, a transfer unit, a cleaning unit, an electric charge removing unit and the like in the order of processes to be carried out by the image forming apparatus. In the image forming apparatus, an image can be formed in the following processes: that is, at first, an electrostatic latent image is formed on the surface of the image carrier by the latent image forming unit, the electrostatic latent image is next developed as a toner image by the developing unit, the toner image is then transferred onto a sheet by the transfer unit, after then, the residual toner on the image carrier is removed by the cleaning unit, and the electric charges of the image carrier are removed by the electric charge removing unit. In some of the image forming apparatus of this type, in more particular, in the image carrier and transfer unit of the image forming apparatus, there is employed a belt conveyor device. That is, in the case of the image carrier, the image carrier itself is formed of an endless bet and, in the case of the transfer unit, the transfer unit carries the sheet by means of an endless belt.

In such endless belt type conveyor device, an endless belt, which is wound around a drive roller and a plurality of driven rollers including a tension applying roller, is driven by the drive roller. In this driving system, however, there is a possibility that a tension applied to the belt can be biased toward the width (that is, in the axial direction of the roller) and the belt can be thereby caused to meander. If the belt meanders, in the case of the image carrier, the latent image to be formed on the belt is then biased or shifted and, in the case of the transfer unit, the toner image to be transferred onto the sheet on the belt is biased, so that a good image cannot be obtained. Especially, in a multi-color type image forming apparatus in which a multi-color image is formed by means of a toner image having a plurality of colors, such poor image can occur outstandingly.

In view of the above, there have been conventionally proposed various kinds of technologies to solve the above-mentioned problem.

Some of the technologies are as follows:

(1) In Japanese Patent Publication No. 54-24033 of Showa, there is disclosed means in which a brake roller is disposed on the outer peripheral side of a belt and a bearing for the brake roller is arranged eccentric to the brake roller, so that the leaning of the belt can be adjusted by changing the contact angle of the brake roller with respect to its opposing roller.

(2) In Japanese Utility Model Publication No. 4-87849 of Heisei, there is disclosed a technology in which one of rollers is formed as a yawing roller and the yawing roller is formed in a drum shape to thereby prevent a belt-like body to be developed (image carrier) from meandering.

(3) In Japanese Patent Publication No. 4-317936 of Heisei, there is disclosed a technology in which two edge guides each having a large diameter are provided at the two ends of a cylindrical roller and the walking of a belt can be restricted by the two edge guides.

(4) In Japanese Patent Publication No. 5-165385 of Heisei, there is disclosed a technology which detects the walking of a belt and moves a roller in the axial direction thereof based on such detection.

(5) In Japanese Patent Publication No. 4-60915 of Heisei, there is disclosed a technology in which a walking belt is made to go up onto a tapered roller and the position of the roller can be shifted due to the rotation thereof.

However, in the technology (1), since the meandering of the belt is corrected by changing the carriage direction of the belt to the lateral direction thereof in a portion of the whole peripheral length thereof, there is a fear that, when the belt meandering is corrected, an unreasonable force can be applied to the belt to thereby shorten the life of the belt. In the technology (2), since the number of the yawing roller is one, there is a limit to the adjustment of the belt meandering when the belt is long and thus the range of the employment of the present technology is limited. Also, in the technology (3), because the belt is always in contact with the edge guides, the end faces of the belt are easy to wear, the belt can be damaged due to the buckling loads given by the edge guides, and, if the belt has a seam, the seam portion of the belt can be cracked easily. That is, a satisfactory performance cannot be obtained from the viewpoint of reliability and maintainability. Also, according to the present technology, since two link mechanisms are respectively provided in the two end portions of the roller, when mounting and removing the belt, these link mechanisms provide a cause to worsen the efficiency of the belt mounting and removing operation.

Further, in the technologies (4) and (5), there is necessary a mechanism for controlling so that the structure thereof is also complicated.

The present invention provides a belt conveyor device which can solve the above-mentioned problems found in the conventional technologies.

SUMMARY OF THE INVENTION

The present invention aims at eliminating the drawbacks found in the above-mentioned conventional technologies. Accordingly, it is an object of the invention to provide an endless belt type conveyor device which does not impair the life of a belt and is able to restrict the meandering of the belt with accuracy regardless of the kinds of the belts use.

In attaining the above object, according to the first invention, there is provided an endless belt type delivery device comprising a drive roller, a plurality of driven rollers including a tension apply roller disposed in such a manner that the respective axial directions of the rollers are set parallel to each other, and an endless belt wound around the respective rollers in such a manner that the endless can be driven by rotating the drive roller, wherein, in at least two of the above-mentioned rollers, there are provided meandering adjusting means for biasing contact pressures between the two or more rollers and the endless belt toward the axial-direction end portions of the rollers.

According to the above-mentioned first invention, the contact pressure between the rollers and the endless belt are biased in the opposite direction to the meandering direction of the endless belt by the meandering adjusting means, thereby being able to correct the meandering of the endless belt. Also, not only since at least two rollers include the meandering adjusting means, the meandering adjusting range can be widened, but also because no unreasonable force can be applied to part of the whole peripheral length of the endless belt, there is eliminated the possibility that the life of the endless belt can be impaired.

Also, according to the first invention, there is provided an endless belt type delivery device comprising a drive roller, a plurality of driven rollers including a tension apply roller disposed in such a manner that the respective axial directions of the rollers are set parallel to each other, and an endless belt wound around the respective rollers in such a manner that the endless can be driven by rotating the drive roller, wherein there is provided pressure means for pressing against the winding portion of the endless belt around the drive roller in the width direction thereof, and, in the pressure means, there is provided meandering adjusting means for biasing the pressure of the pressure means toward the axial-direction end portion of the drive roller.

According to the above-mentioned first invention, the pressure of the pressure means is biased in the opposite direction to the meandering direction of the endless belt by the meandering adjusting means, thereby being able to correct the meandering of the endless belt. According to the present invention as well, since no unreasonable force can be applied to part of the whole peripheral length of the endless belt, there is eliminated the possibility that the life of the endless belt can be impaired.

Further, according to the second invention, at least one of a plurality of rotary rollers is used as a displacement roller which is displaced as the endless belt is moved in the axial direction of the displacement roller.

According to the second invention, if the endless belt is going to move in the axial direction of the displacement roller, then the displacement roller is moved in a direction in which the movement of the endless belt in the axial direction of the displacement roller is prevented, thereby being able to correct the movement of the endless belt in the axial direction of the displacement roller automatically.

DETAILED DESCRIPTION OF THE PREFERRED EMBODIMENTS

Now, description will be given below of embodiments of an endless belt delivery device according to the invention which are applied to a transfer belt employed in an image forming apparatus.

At first, description will be given below of a first embodiment of an endless belt type delivery device according to the invention.

A. First Embodiment

Figure 1:
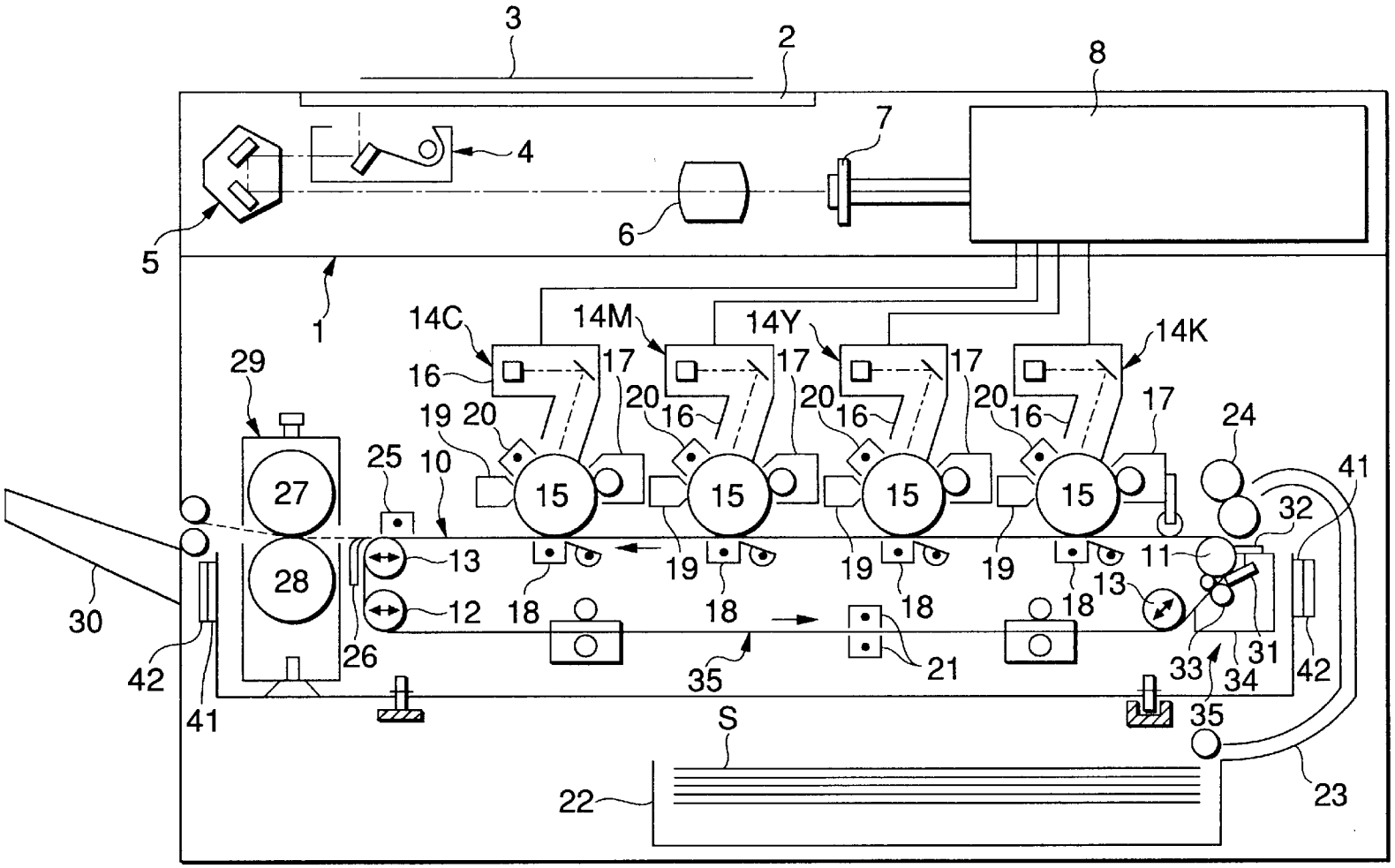
FIG. 1 is a side view of a general structure of an image forming apparatus to which first and second embodiments of a endless belt delivery device according to the invention are applied.

FIG. 1 shows the whole of a so called tandem-type full-color image forming apparatus to which a first embodiment of and endless belt type delivery device according to the invention is applied. In the following description, the terms "front and rear directions" and "right and left directions" are respectively defined as "the front and back directions" and "right and left directions" in FIG. 1. In FIG. 1, reference character P designates a box-shaped apparatus main body, 1 stands for a read unit which is used to read an image of a manuscript 3 set on a platen glass 2 serving as a manuscript placement member, and 10 expresses a transfer belt used to carry or convey a sheet onto which the image of the manuscript is transferred or copied.

The transfer belt 10, which is an endless belt coated with a dielectric film, is wound around a drive roller 11 and a tension apply roller 12 disposed in parallel to each other, and a plurality of driven rollers 13. The transfer belt 10 can be driven in a direction shown by arrows in FIG. 1 by means of the rotation of the drive roller 11. Upwardly of the upper flat traveling portion of the transfer belt 10, there are disposed image forming units 14K, 14Y, 14M and 14C respectively for black, yellow, magenta and cyan in such a manner that they extend along the traveling direction of the transfer belt and are respectively spaced at regular intervals from the upstream side of FIG. 1. Each of the image forming units 14K, 14Y, 14M and 14C comprises a photoconductor drum 15, latent image write means 16 disposed in the periphery of the photoconductor drum 15, a developing device 17, a transfer corotron 18, a cleaning device 19, and an electric charge removing corotron 20 for the photoconductor drum 15. Also, in the lower horizontal traveling portion of the transfer belt 10, there is provided an electric charge removing corotron 21 for the transfer belt 10. The read unit 1 scans the image of the manuscript 3 optically by means of first and second scanners 4 and 5 and sends the image signal of the scanned image through a lens 6 and a CCD 7 to an image output portion 8; and, on receipt of the image signal, the image output portion 8 outputs the image signal to the respective latent image write means 16 of the image forming units 14K, 14Y, 14M and 14C.

Below the transfer belt 10, there is mounted a sheet feed tray 22 which are used to store a large number of sheets S. The sheet S is passed through a delivery guide 23 and the feed timing of the sheet S is adjusted by a pair of registration rollers 24 and, after then, the sheet S is fed onto the transfer belt 10. Also, downstream of the image forming unit 14C that is disposed in the final stage of the image forming units, there are provided a peel-off corotron 25 and a peel-off claw 26, and there is further provided a fixing device 29 which consists of a combination of a heating roller 27 and a pressurizing roller 28. Downstream of the fixing device 29, there is provided a sheet discharge tray 30. Also, in the right end portion of the transfer belt 10, that is, in the final downstream side portion of the transfer belt 10, there is disposed a cleaning unit 35 which is composed of first and second cleaning blades 31 and 32 and a cleaning brush 33 respectively for scraping away and thereby removing the toners that have adhered to and retained on the surface of the transfer belt 10, a collecting box 34 for collecting the thus scraped-away toners, and the like.

According to the present image forming apparatus, the image of the manuscript 3 is read by the read unit and the image signal thereof is output to the respective latent write means 16 of the image forming units 14K, 14Y, 14M and 14C. The photoconductor drum 15 is uniformly charged by the latent image write means 16 and the image is exposed onto the charged layer of the photoconductor drum 15, so that a latent image is formed. The thus formed latent image is then developed by the developing device 17 to provide a visible image, that is, a toner image and, next, the toner image is transferred by the transfer corotron 18 onto the sheet S that is carried by the transfer belt 10. After the toner image is transferred to the sheet S, the toners retained on the photoconductor drum 15 are removed by the cleaning device 19 and, after then, the electric charges that have been applied to the photoconductor drum 15 are removed by the electric charge removing corotron 20. This series of image forming cycles are carried out for each of the image forming units 14K, 14Y, 14M and 14C as the sheet S is delivered, so that the toner images of these four colors can be sequentially transferred onto the sheet S.

The sheet S, which has passed through the image forming unit in the final stage, is peeled off from the transfer belt 10 by the peel-off corotron 25 and peel-off claw 26 and is then allowed to reach the fixing device 29. In the fixing device 29, the toner image on the sheet S is fixed and the toner image is developed in multiple colors and, after then, the sheet S is discharged out to the sheet discharge tray 30. The electric charges of the transfer belt 10 applied by the transfer corotrons 18 are removed by the electric charge removing corotron 21, while the residual toners adhered to the surface of the transfer belt 10 are removed by the first and-second cleaning blades 31 and 32. The thus removed toners are dropped down and collected into the collecting box 33.

Figure 2:
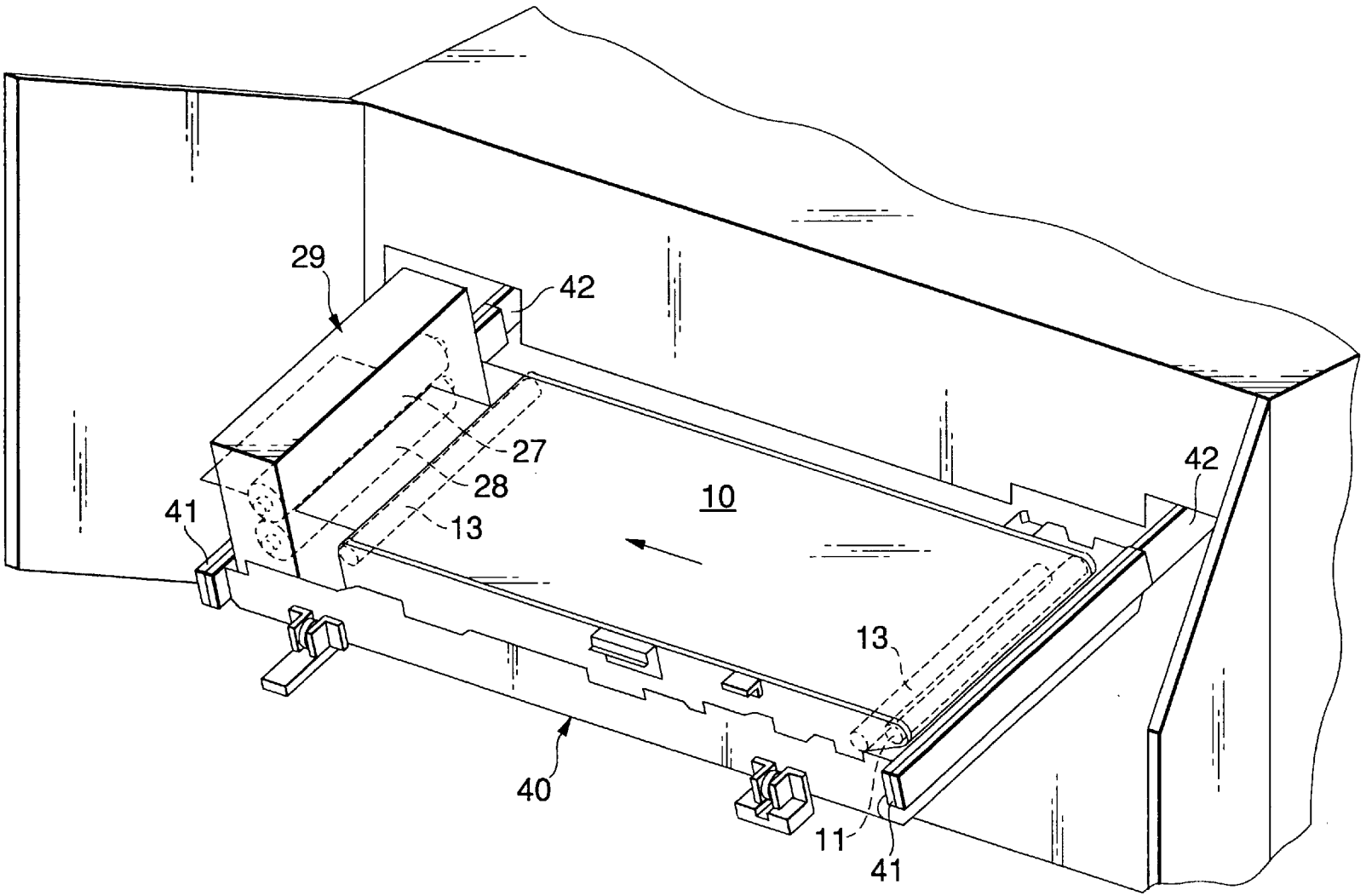
FIG. 2 is a perspective view of part of the above image forming apparatus.

The transfer belt 10, transfer corotrons 18 and the like cooperate together in forming the transfer device 35. The transfer device 35, the above-mentioned fixing device 29 and the like are supported by a frame 40. The frame 40 is supported in such a manner that it can be slided back and forth along two rails 42 disposed within the apparatus main body P through two sliders 41 respectively provided on the right and left sides of the frame 40. Also, the transfer device 35, fixing device 29 and the like, as shown in FIG. 2, can be inserted into and taken out from the apparatus main body P from this side together with the frame 40 integrally with the frame.

The transfer belt 10, as described before, is wound around the drive roller 11, tension apply roller 12, and driven rollers 13 respectively disposed adjacent to these rollers 11 and 12. The drive roller 11 is rotatably supported on a pair of front and rear belt frames 43 shown in FIG. 3, whereas the tension apply roller 12 and driven rollers 13 are rotatably supported on the belt frames 43 through support arms to be discussed later. In each of the belt frames 43, there is provided a tension apply mechanism 50 which is used to apply a tension to the transfer belt 10 through the tension apply roller 12.

Figure 3:
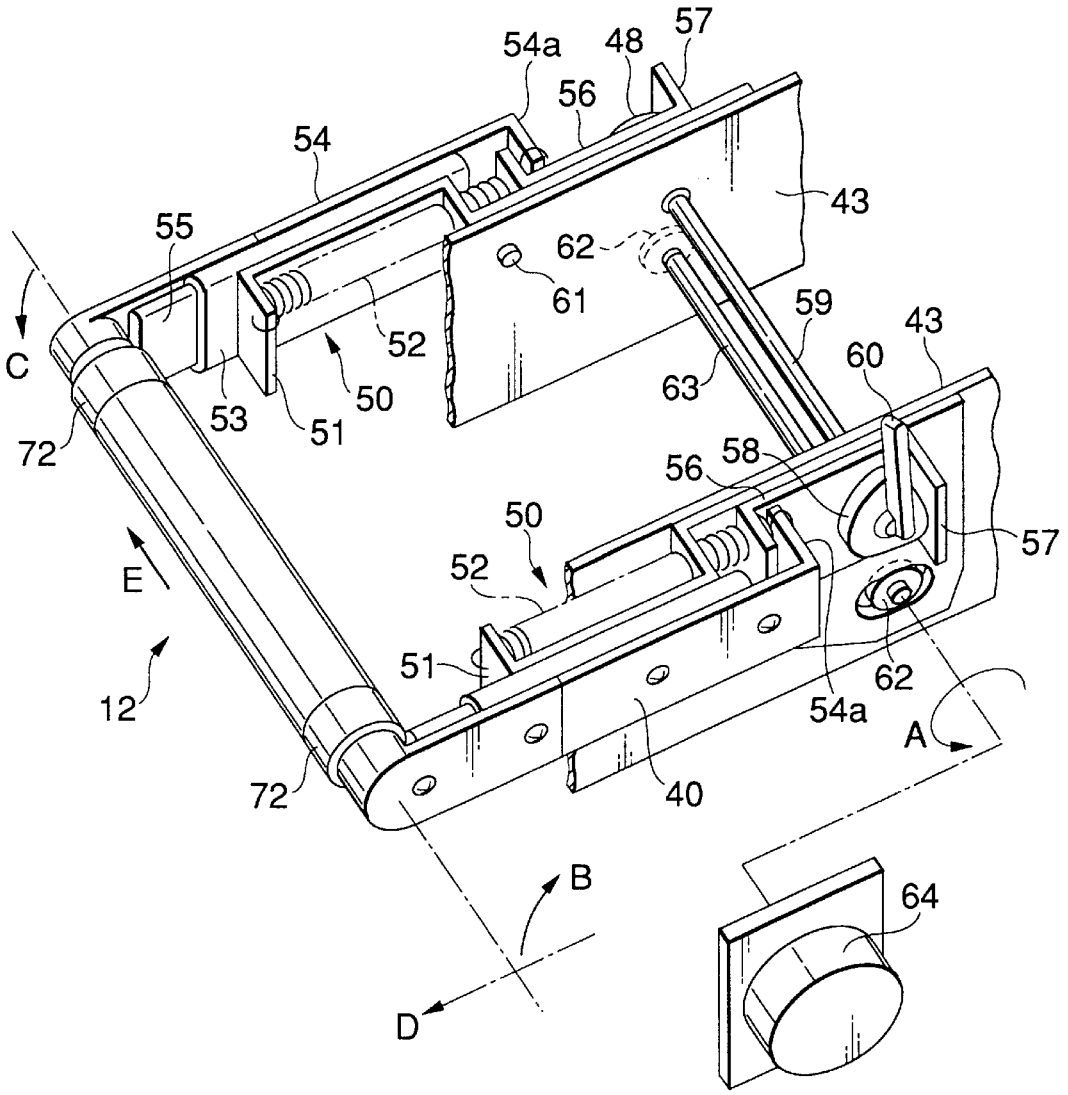
FIG. 3 is a perspective view of part of the above image forming apparatus, explaining a tension apply mechanism employed therein.
Figure 4:
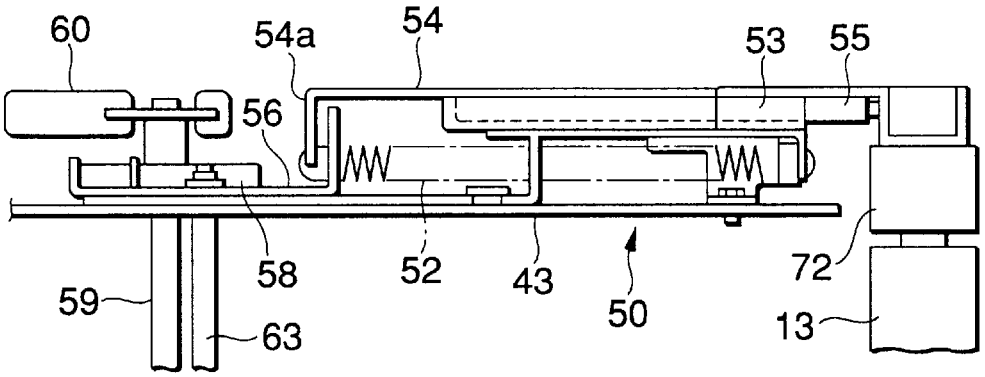
FIG. 4 is a plan view of part of FIG. 1.

The tension apply mechanism 50, as shown in FIGS. 3 and 4, comprises a bracket 51 to be fixed to the belt frame 43, a spring 52 arranged such that one end portion thereof is fixed to the inside leading end portion of the bracket 51, and a slide rail 53 disposed outside the bracket 51. The two end portions of the tension apply roller 12 are rotatably supported by a support arm 54 and, inside the support arm 54, there is formed a rail movable portion 55. Also, the rail movable portion 55 of the support arm 54 is fitted into the slide rail 53 and the leading end portion 54a of the support arm 54 is fixed to the spring 52. Thanks to this structure, the support arm 54 is energized in a direction of an arrow D shown in FIG. 3 due to the elastic force of the spring 52, thereby being able to apply a given level of tension to the transfer belt 10 through the tension apply roller 12.

Also, to the spring 52, on the leading portion side of the support arm 54, there is fixed one end portion of a removing blade 56. The removing blade 56 includes a bent portion 57 in the other end portion thereof, while a removing cam 58 can be butted against the bent portion 57 of the removing blade 56. The removing cam 58 consists of front and rear cams which are respectively mounted on the two ends of a cam shaft 59 extending between the two belt frames 43, while the front cam 58 includes a removing lever 60. When the removing lever 60 is positioned in the illustrated state, the support arm 54 is energized so that a tension can be given to the transfer belt 10. If the removing lever 60 has fallen down, then the removing blade 56 pulls the support arm 54 against the spring 52, thereby being able to remove the tension acting on the transfer belt 10.

Also, the bracket 51 of the tension apply mechanism 50 is mounted on the belt frame 43 in such a manner that it can be rotated about a shaft 61. There is further provided an inclining cam (an inclining mechanism) 62 which is able to control the rotational movement of the bracket 51 as well as is able to incline the rotary shaft of the tension apply roller 12. These inclining cams 62 are respectively installed on the two ends of a cam shaft 63 which is so disposed as to extend between the belt frames 43. According to the inclining cams 62, when the cam shaft 63 is rotated in a direction of an arrow A shown in FIG. 3, then the front support arm 54 can be rotated in a direction of an arrow B shown in FIG. 3, whereas the rear support arm 54 can be rotated in the opposite direction, that is, in a direction of an arrow C shown in FIG. 3. Due to such rotational movements of the front and rear support arms 54 in the mutually opposite directions, the tension apply roller 12 can be inclined in the illustrated direction. The cam shaft 63 can be driven by a motor 64.

Figure 5:
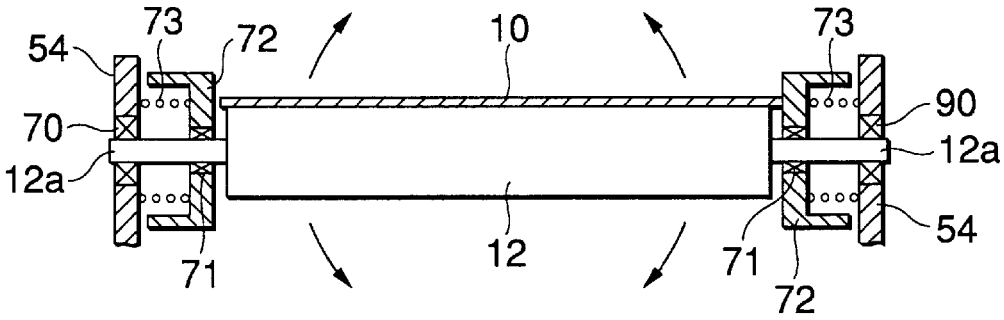
FIG. 5 is a front view of a structure for inclining a tension apply roller.

As shown in FIG. 5, the rotary shaft 12a of the tension apply roller 12 is supported by the support arms 54 through bearings 70. Between the tension apply roller 12 and the respective support arms 54, there are journaled belt guides 72 through their respective bearings 71 in such a manner that they are free to slide in the axial direction thereof. Between the respective belt guides 72 and support arms 54, there are inserted springs 73, whereby the end of the transfer belt 10 is supported in an elastic manner.

Figure 6:
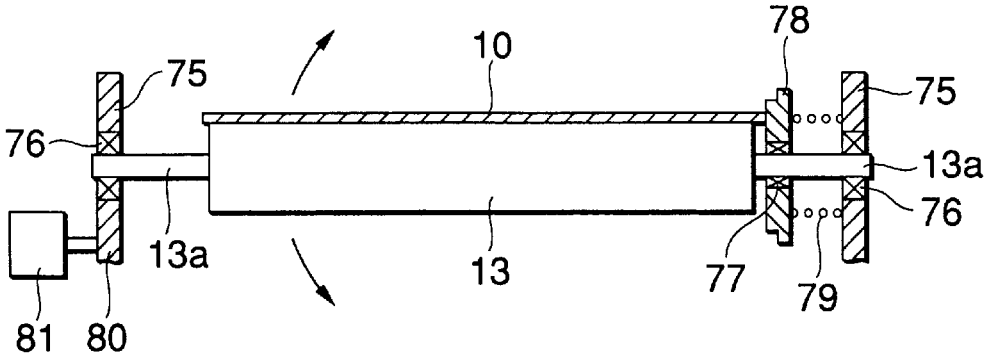
FIG. 6 is a front view of a structure for inclining a driven roller.

Also, the two driven rollers 13 are structured such that they can be inclined in the axial direction thereof about their respective rear shaft end portions. That is, each of the two driven rollers 13 is structured such that, as shown in FIG. 6, the rotary shafts 13*a* thereof are rotatably supported by support arms 75 similar to the above-mentioned support arms 54 through bearings 76, while a belt guide 78 is rotatably journaled through a bearing 77 between the rear (in FIG. 6, the right) support arm 75 and the driven roller 13. A spring 79 is inserted between the belt guide 78 and the support arm 75, whereby the end portion of the transfer belt 10 is supported in an elastic manner. The front support arm 75 can be moved freely by an inclining cam (an inclining mechanism) 80 and, if the inclining cam 80 is rotated, then the two driven roller 13 can be inclined respectively in the arrow directions shown in FIG. 1 with their respective rear end portions as the inclining axes thereof. The inclining cam 80 can be driven by a motor 81.

According to the present structure, the end portion of the transfer belt 10 can be butted against the above-mentioned belt guides 72 and 78 under a certain contact load to thereby prevent the transfer belt 10 from meandering, so that the transfer belt 10 can be driven stably. That is, in the present embodiment, there are provided detect means (not shown) for detecting such contact load, and a control unit (not shown) which receives a signal from the detect means and transmits drive signals to the above-mentioned respective motors. Now, description will be given below of the operation of the above-mentioned transfer belt delivery device including the control unit.

The transfer belt 10 can get in contact with the respective belt guides 72 and 78 under a certain load and thus can be driven stably. However, the average load acting on the belt guides 72 and 78 is caused to vary due to the degrees of parallelism between the rollers, the cylindrical precision of the rollers, differences between the peripheral lengths of the two end portions of the transfer belt 10, and other parameters. The positions of the belt guides 72 and 78, that is, the position of the transfer belt 10 in the width direction thereof is caused to vary according to the average load acting on the belt guides 72 and 78. If the average load of the transfer belt 10 acting on the belt guides 72 and 78 exceeds a given range, then the detect means detects this, that is, judges that the transfer belt 10 has meandered, and transmits a detect signal to the control unit. On receiving the detect signal, the control unit drives the respective cams 62 and 80 so that the meandering of the transfer belt 10 can be corrected. For example, as shown in FIG. 3, if the cam 62 is rotated in the A direction, then the tension apply roller 12 is inclined in the arrow direction of FIG. 1 and, as the tension apply roller 12 is inclined in this manner, the transfer belt 10 is caused to move in the E direction (in the rear direction) in which the contact pressure of the transfer belt 10 is higher. Also, the respective driven rollers 13 are inclined in the arrow direction of FIG. 1, so that the transfer belt 10 is moved in a direction in which its contact pressure with respect to the driven rollers 13 is higher. Since the transfer belt 10 is moved in this manner, the meandering of the transfer belt 10 can be restricted accurately.

In the above-mentioned embodiment, since the tension apply roller 12 and two driven rollers 13, that is, a total of three rollers can be inclined to thereby correct the meandering of the transfer belt 10, the meandering of the transfer belt 10 can be adjusted in a wider range than a structure in which a single roller is inclined. For example, even in a structure in which the transfer belt 10 is long and the number of rollers used is large so that the transfer belt 10 is easy to meander and the degree of the meandering of the transfer belt 10 is apt to be large, the present embodiment is able to restrict the meandering of the transfer belt 10 with accuracy. Also, because there is eliminated the possibility that an unreasonable force can be applied to part of the whole peripheral length of the transfer belt 10, the transfer belt 10 is prevented from being impaired in life.

Besides the above-mentioned adjusting method in which the three rollers are inclined sequentially to thereby correct the meandering of the transfer belt 10, for example, the meandering of the transfer belt 10 can be corrected by the following adjusting methods as well.

That is, (1): The meandering of the transfer belt 10 is firstly adjusted roughly by inclining the tension apply roller 12 and, next, the two driven rollers 13 are inclined one by one to thereby adjust finely the meandering of the transfer belt 10. In this method, if the meandering of the transfer belt 10 can be corrected by the two rollers, then it is not necessary to incline the third roller. Or, on the contrary, the two driven rollers 13 may be firstly inclined to adjust roughly the meandering of the transfer belt 10 and, next, the tension apply roller 12 may be inclined to make the fine adjustment of the meandering of the transfer belt 10.

(2): For example, when the degree of the meandering of the transfer belt 10 is large, the transfer belt 10 is firstly moved to the utmost limit by the tension apply roller 12 and, next, one or both of the two driven rollers 13 are inclined until the meandering of the transfer belt 10 can be corrected completely.

B. Second Embodiment

Next, description will be given below of a second embodiment of an endless belt type delivery device according to the invention. In the first embodiment, as described above, the meandering of the transfer belt 10 is corrected by inclining the rollers. On the other hand, in the second embodiment, the meandering of the transfer belt 10 is corrected by the above-mentioned second cleaning blade 32. At first, description will be given below of the above-mentioned cleaning unit 35 including the second cleaning blade 32.

Figure 7:
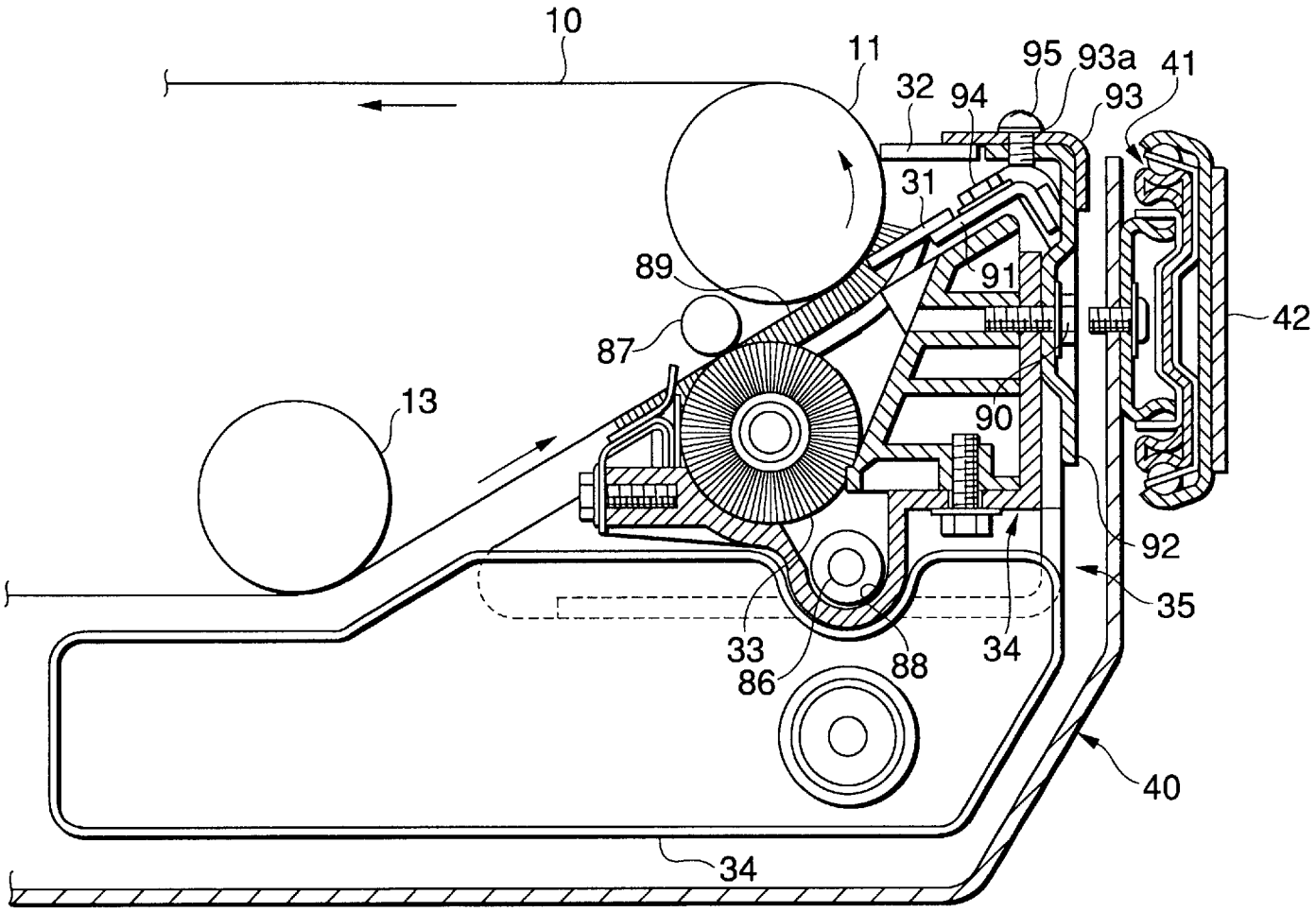
FIG. 7 is a side view of a cleaning unit employed in the present endless belt delivery device.

As shown in FIG. 7, the cleaning unit 35 comprises a cylindrical brush 33 for cleaning, a toner collecting auger 86, a housing 34 for supporting the brush 33 and auger 86, the above-mentioned toner collecting box 35 disposed in the lower portion of the housing 34, and first and second cleaning blades (which are hereinafter referred to simply as blades) 31 and 32. The first and second blades 31 and 32 are formed of elastic material such as rubber, resin or the like in a plate shape having a sufficient length to cover the width of the transfer belt 10.

The brush 33 is disposed in parallel to the drive roller 11 so that the outer peripheral portion thereof can be pressure contacted with the surface of the traveling portion of the transfer belt 10 extending from the driven roller 13 to the drive roller 11. The brush 33 can be driven and rotated in the same direction as the drive roller 11 and, due to the rotation thereof, the brush 33 can scrape down the toners adhered to the surface of the transfer belt 10 to thereby remove the same. Inside the transfer belt 10, there is disposed a pressure receive roller 87 in such a manner that the transfer belt 10 is held by and between the brush 33 and the pressure receive roller 87. The inner surface of the transfer belt 10 pressed by the brush 33 can be contacted with the pressure receive roller 87, so that the brush 33 can be pressed against the transfer belt 10 with uniform pressure in the axial direction of the transfer belt 10.

In the bottom portion of the housing 34, there is formed a toner storage groove 88 which extends in the longitudinal direction of the housing 34, while the toner collecting auger 86 is stored in the toner storage groove 88. The toners, which have been scraped down by the brush 33, are stored in the toner storage groove 88. The thus stored toners are then delivered to the rear portion of the toner storage groove 88 by the toner collecting auger 86 rotating about the axis thereof and, after then, they are dropped down into the toner collecting box 35. Before and behind the housing 34, there are provided shutters 89 which respectively cover gaps between the housing 34 and transfer belt 10 to thereby prevent the toners from flying away from the housing 34.

The first blade 31 is fixedly secured by adhesion or by similar suitable means to the leading end of a first bracket 91 which is in turn fixed to the upper portion of the housing 34 by a bolt 90. The first blade 31 is directed in the opposite direction to the driving direction of the transfer belt 10 wound around the drive roller 11. In operation, the upper edge of the leading end portion of the first blade 31 can be elastically pressed against the surface of the transfer belt 10, so that the toners retained on the surface of the transfer belt 10 can be scraped down by this upper edge. The first blade 31 includes a bolt insertion hole (not shown) which is formed as an elongated hole, while the first blade 31 is free to advance and retreat with respect to the drive roller 11. Thanks to this structure, it is possible to adjust the amount of biting of the first blade 31 into the transfer belt 10.

Also, a second bracket 92 is fixed to the right end face of the housing 34 by a bolt 94 and a third bracket 93 is further fixed to the upper portion of the second bracket 92 by a screw 95, while the second blade 32 is fixedly secured by adhesion or by similar suitable means to the leading end of the third bracket 93. The second blade 32 is directed in the forward direction or in the same direction as the driving direction of the transfer belt 10 wound around the drive roller 11, while the lower surface of the second blade 32 faces the transfer belt 10. Also, the upper edge of the leading end portion of the second blade 32 can be elastically pressed against the surface of the transfer belt 10, so that the toners adhered to the surface of the transfer belt 10 can be scraped down by the upper edge. The third bracket 93 includes a bolt insertion hole 93*a* which is formed as an elongated hole, while the second blade 32 is free to advance and retreat with respect to the drive roller 11. This makes it possible to adjust the amount of biting of the second blade 32 into the transfer belt 10.

Next, description will be given below of an operation to correct the meandering of the transfer belt 10 by means of the second blade 32.

The second blade 32 is structured such that the amount of biting of the second blade 32 into the transfer belt 10 can be adjusted by loosening the screw 95 to thereby adjust the fixed position of the third bracket 93 with respect to the second bracket 92, which makes it possible to adjust the amount of biting of the second blade 32 in the longitudinal direction (that is, the back-and-forth direction) thereof. If the amount of biting of the second blade 32 in the longitudinal direction is not set uniform but can be biased in either of the two end portions thereof, then the pressure of the second bracket 92 can be biased or applied to the biased end portion thereof. That is, the third bracket 93, which is capable of adjusting the fixed position of the second blade 32, serves as pressure adjusting means which biases the pressure of the second blade 32 toward the end portion side of the drive roller 11 in the axial direction thereof.

If the pressure of the second blade 32 with respect to the transfer belt 10 is biased toward one end portion side thereof in the above-mentioned manner, then the contact pressure of the transfer belt 10 with respect to the drive roller 11 becomes higher on the present end portion side, so that the transfer belt 10 is caused to move toward the present end portion side. Accordingly, for example, when the transfer belt 10 has a tendency to meander on the front side thereof, the amount of biting of the second blade 32 into the transfer belt 10 may be set larger on the rear side thereof. Then, if the bias amount of the pressure of the second blade 32 is adjusted properly, then the transfer belt 10 is caused to move backward, so that the meandering of the transfer belt 10 can be corrected.

Figure 8:
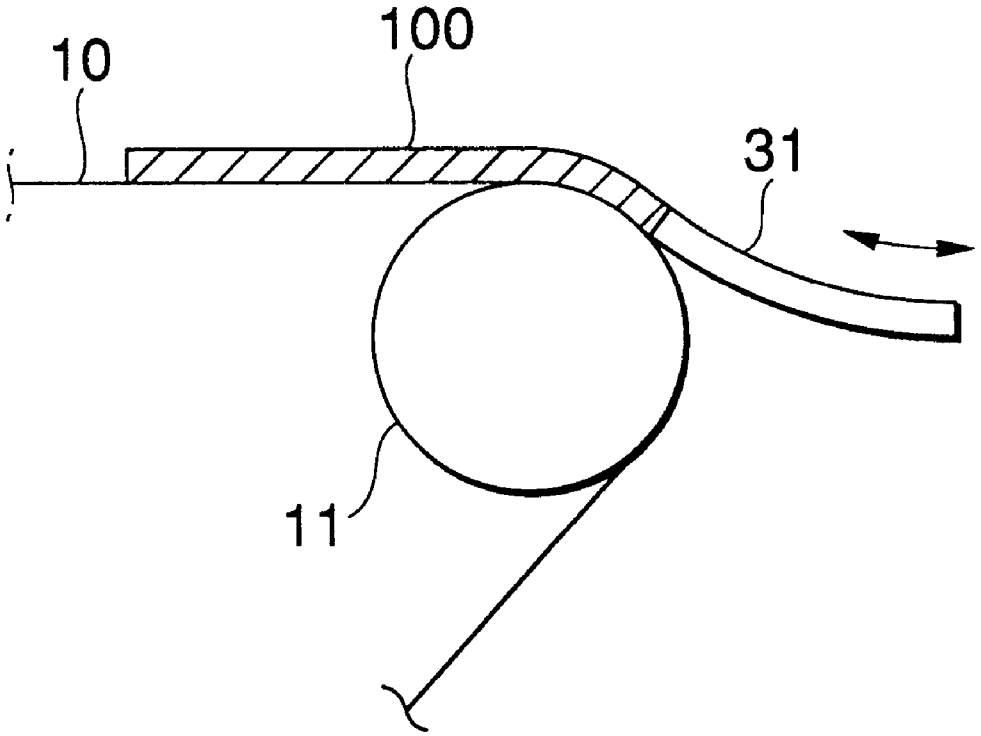
FIG. 8 is an explanatory side view of a jig for adjusting the position of a second cleaning blade.

However, conversely speaking, the fact that the meandering of the transfer belt 10 can be corrected by means of the pressure of the second blade 32 in this manner may also suggest a fear that, if the amount of biting of the second blade 32 into the transfer belt 10 is not uniform in the longitudinal direction of the drive roller 11, then the transfer belt 10 can be made to meander. For this reason, in order to make uniform the initial value of the biting amount, there is used a jig 100 shown in FIG. 8. The jig 100 is a plate-like device which is structured such that the leading end portion thereof is curved along the outer peripheral surface of the drive roller 11 and, with the curved leading end portion thereof engaged with the surface of the transfer belt 10, the leading end edge thereof extends along the axial direction of the drive roller 11. If the leading end edge of the second blade 32 is butted against the leading end edge of the jig 100, then it is possible to make uniform the biting amount of the second blade 32 into the transfer belt 10.

To adjust the biting amount of the second blade 32 in the above-mentioned manner, the frame 40 is pulled out and the transfer belt 10 is then taken out from the apparatus main body P. In this case, of course, the second blade 32 can be seen visually. Therefore, the biting amount of the second blade 32 can be confirmed directly, that is, visually.

The above-mentioned first invention is not limited to the above-mentioned respective embodiments but, for example, the following modifications are also possible.

(1): The transfer belt delivery device is structured such that it includes both of the first and second embodiments. That is, the transfer belt delivery device is structured in such a manner that the meandering of the transfer belt can be corrected according to the two correcting techniques: that is, in one technique, a plurality of roller are inclined; and, in the other, the pressure of the blade is adjusted. This structure can further widen the range of the meandering correcting method. According to this structure, for example, the meandering of the transfer belt 10 can be firstly adjusted roughly by means of the blade and, after then, the meandering can be adjusted finely by means of inclination of the rollers.

(2) In the first embodiment, a plurality of rollers including the drive roller are structured such that they can be inclined respectively.

(3) In the third embodiment, instead of the blade, other pressure means is used to correct the meandering of the transfer belt 10.

(4) The present invention is applied to every endless belt delivery device using not only the transfer belt but also the image carrier delivery belt, intermediate transfer belt and other kinds of belts of an image forming apparatus.

(5) The present invention can be applied to not only the belt-type delivery device of the image forming apparatus but also the endless belt type delivery devices of other kinds of instruments.

Next, description will be given below of embodiments of a belt delivery device according to the second invention.

Figure 9:
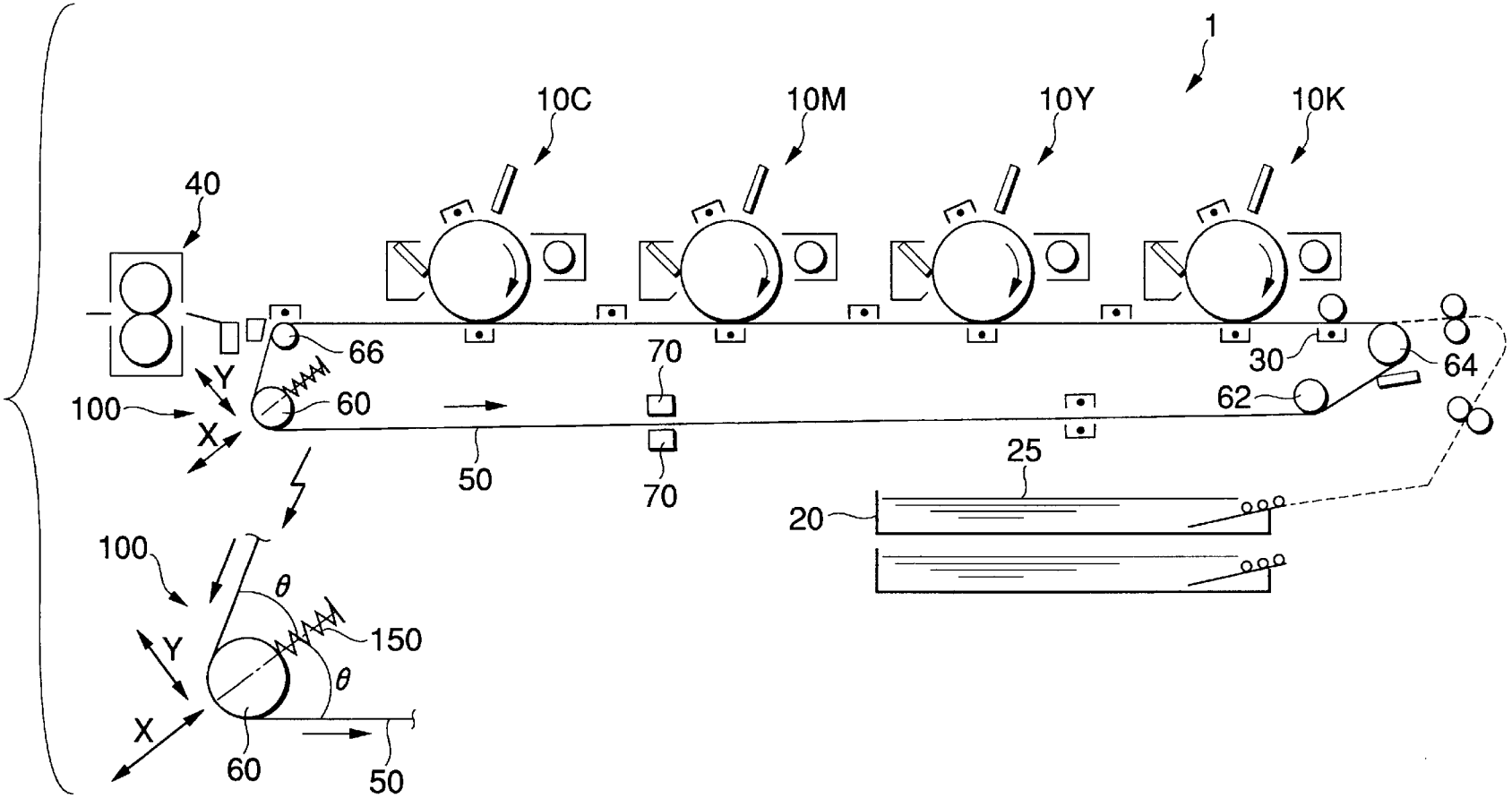
FIG. 9 is an explanatory view of the outline of an image informing apparatus in which the invention is enforced.

Firstly, FIG. 9 shows an embodiment in which a belt delivery device according to the second invention is enforced in an image forming apparatus using an endless belt.

An image forming apparatus, the whole of which is designated by reference character 1, includes four developing devices which are respectively disposed on the traveling path of an endless belt 50. Recording sheets 25, which have been prepared in a tray 20, are fed out one by one from the tray 20 and are then attracted onto the endless belt 50 to be electrically charged by a corotron 30. As the belt 50 is moved, the recording sheet 25 is passed through the developing devices 10K, 10Y, 10M and 10C sequentially, whereby the respective colors of the developing devices are transferred to the recording sheet 25. After developed, the recording sheet 25 is fixed by a fixing device 40, so that a full-color image is formed on the recording sheet 25.

According to the present image forming apparatus, the endless belt 50, which is used to deliver the recording sheets, is wound around four rollers 60, 62, 64 and 66 and, for example, the roller 64 can be driven by a drive mechanism. The two rollers 62 and 66 are respectively idle rollers and the roller 60 functions as a tension roller, while a spring 150 of a roller tension device 100 always applies a constant tension to the endless belt 50.

The endless belt 50 is in contact with the outer periphery of the tension roller 60 at a certain angle. This angle is referred to as a lap angle, an axis X which bisects the lap angle 2θ is referred to as a hard axis, and an axis which crosses the hard axis X at right angles is referred to as a soft axis.

Figure 10:
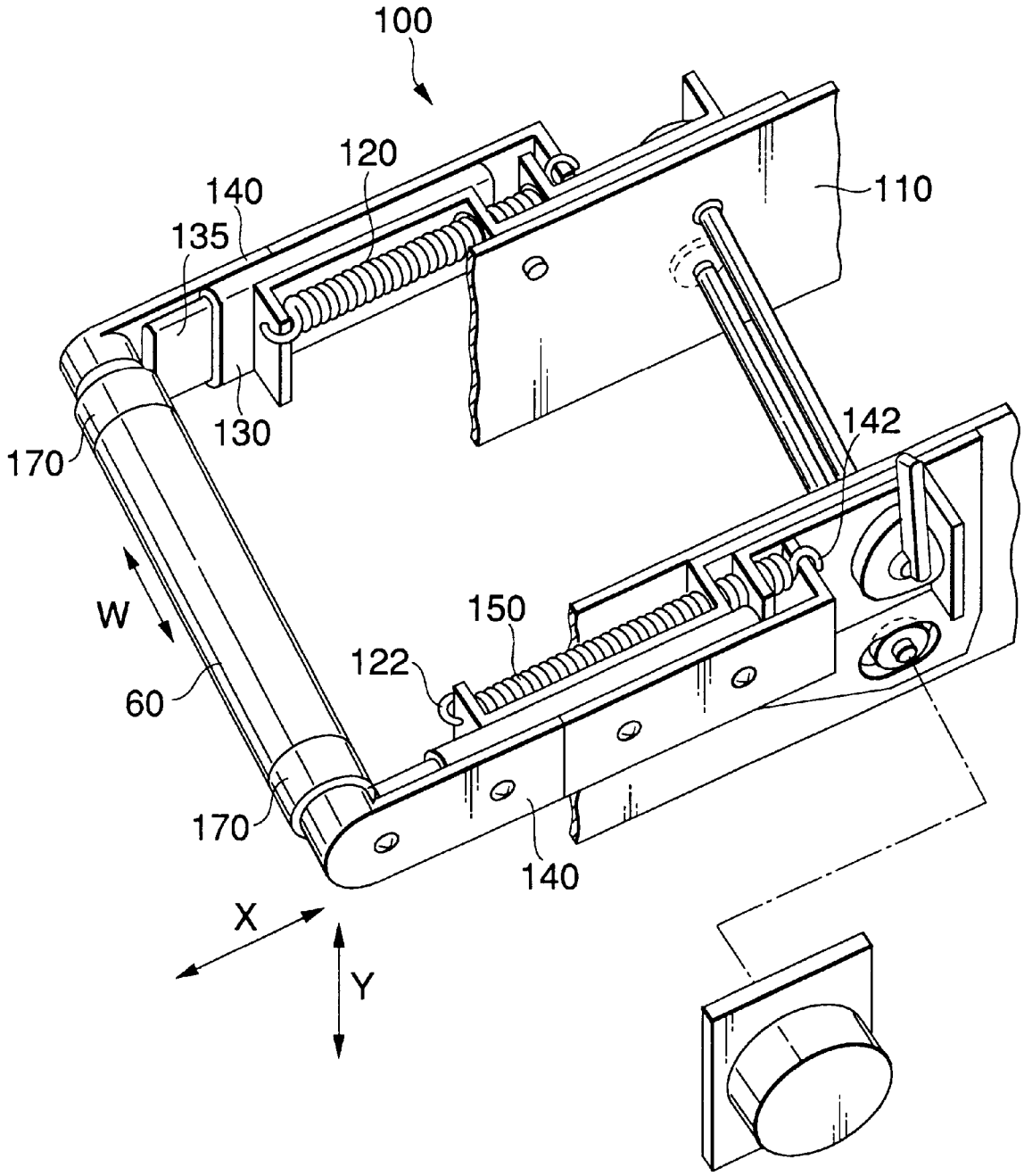
FIG. 10 is an explanatory view of a tension roller device.
Figure 11:
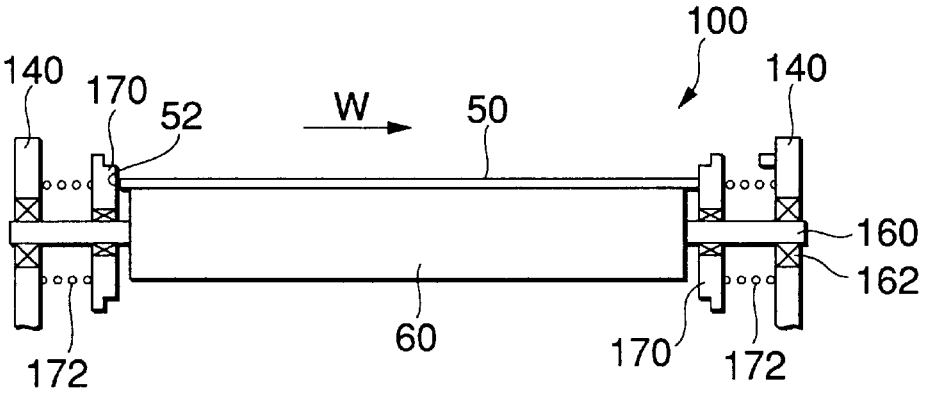
FIG. 11 is an X arrow view of FIG. 10.

In FIGS. 10 and 11, there are shown the details of the tension device 100 which applies a tensile force to the endless belt 50.

The tension device 100 includes a pair of brackets 120 which are respectively fixedly secured to a frame 110 of the present image forming apparatus. A guide rail 130 is fixed to the bracket 120, while a slider 135 can be inserted into the guide rail 130. A sliding arm 140 is attached to the outer side of the slide 135. The slider 135 includes a roller which travels on the guide rail 130, while the sliding arm 140 is fastened to the slider 135.

Thanks to this structure, the sliding arm 140 can be guided by the guide rail 130 and also can be moved in the X axis direction at a speed twice the moving speed of the slider 135. Since the movement of the sliding arm is carried out through the roller, the moving resistance thereof is small and thus the smooth movement can be achieved.

A coil spring 150 is provided between the end portion 122 of the bracket 120 fixed to the frame 110 and the rear end portion 142 of the sliding arm 140. This coil spring 150 always energizes the sliding arm 140 in a direction in which the arm 140 is projected from the bracket 120.

The tension roller 60 is supported on the respective leading end portions of a pair of sliding arms 140. The tension roller 60 includes a shaft 160 which is rotatably supported by the arms 140 through bearings 162. The endless belt 50 is placed on and around the tension roller 60. The movement of the endless belt 50 in the axial direction W of the tension roller 60, as described previously, is referred to as "walk". On the two sides of the tension roller 60, there are provided flange rollers 170 which respectively have a larger diameter than that of the tension roller 60, so that the walks of the side portions 52 of the endless belt 50 can be restricted.

The flange rollers 170 can be structured such that they can be energized toward the tension roller 60 by means of springs 172 respectively. This structure can relieve a force acting on the side portions 52 of the endless belt 50.

Next, description will be given below of the principles and concrete embodiments of the present invention with reference to FIGS. 12, 13 and 14.

Figure 12:
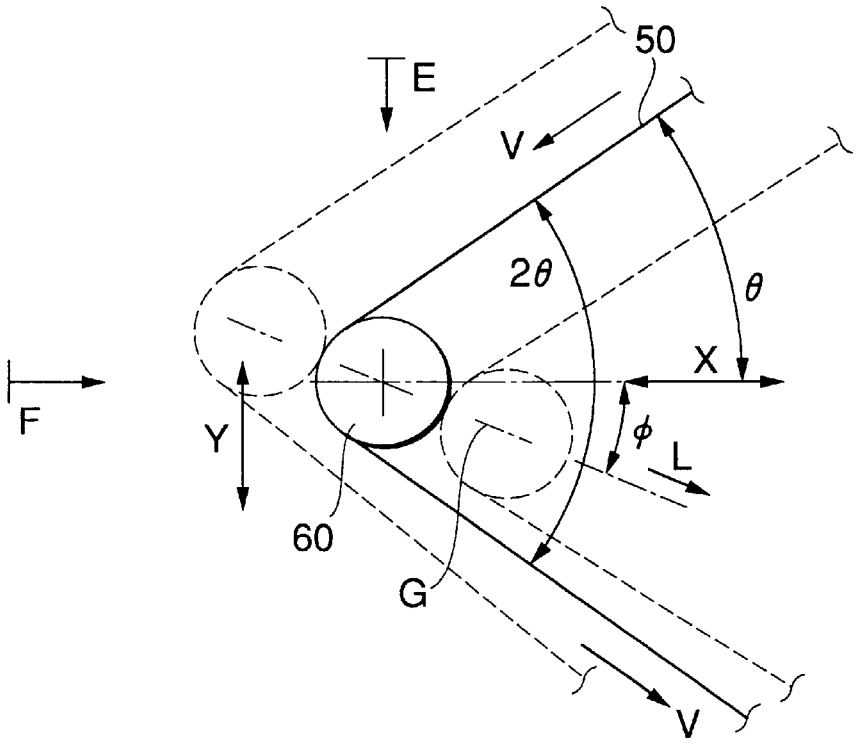
FIG. 12 is a side view of a tension roller.
Figure 13:
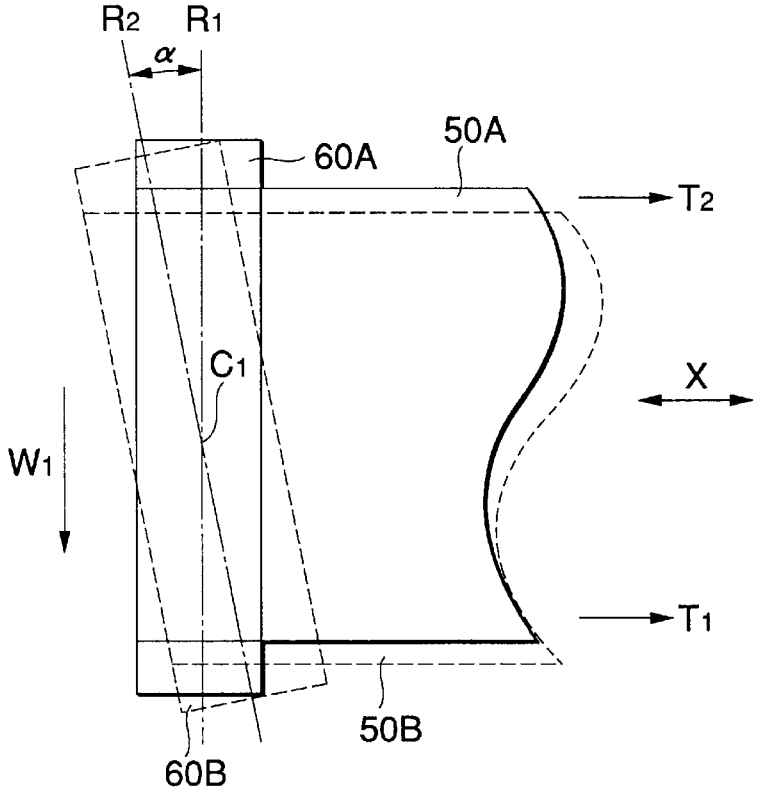
FIG. 13 is an E arrow view of FIG. 12.
Figure 14:
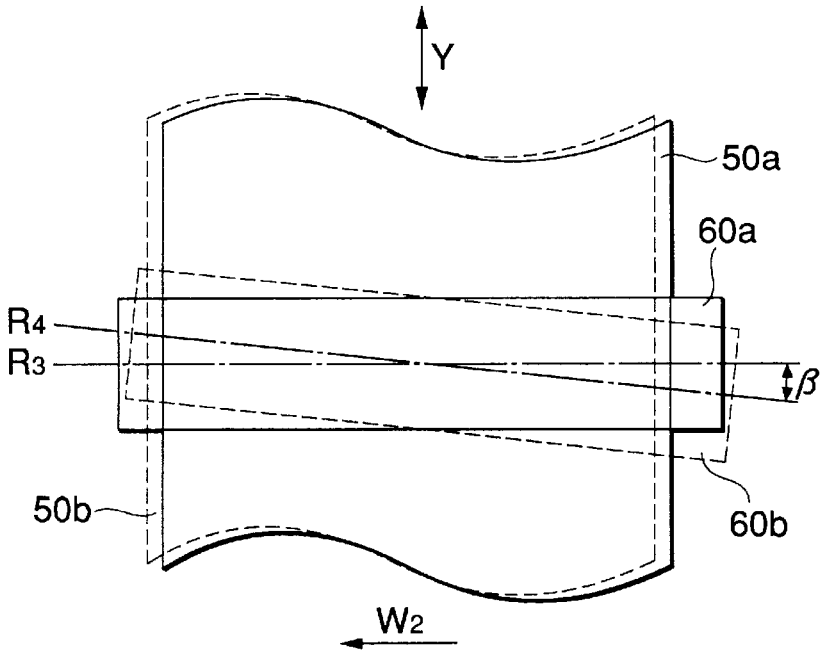
FIG. 14 is an F arrow view of FIG. 12.

In particular, FIG. 12 is a side view of the endless belt 50, showing a state thereof in which it is placed around the tension roller 60, FIG. 13 is a view of the endless belt 50, taken along the arrow E shown in FIG. 12, and FIG. 14 is a view of the endless belt 50, taken along the arrow F shown in FIG. 12.

The endless belt 50 is placed around the tension roller 60 at a contact angle (lap angle) of an angle 2θ with respect to the tension roller 60. An axis X, which extends at an angle θ obtained by bisecting the lap angle 2θ and passes through the center of the tension roller 60, is referred to as a hard axis, as described above. The reason why this axis X is referred to as a hard axis is that, when the tension roller 60 is moved in a direction in which a tensile force is applied to the endless belt 50, there is generated large resistance.

An axis Y, which intersects the hard axis X at right angles on the plane of FIG. 12, is referred to as a soft axis. The reason for this is that, when the tension roller 60 is moved in the axis Y direction, there is generated only small resistance.

FIG. 13 is an E arrow view of FIG. 12, that is, an explanatory view in which the walk of the endless belt 50 in a plane containing the axis R1 of the tension roller 60 and the hard axis X is analyzed.

In a normal condition, the endless belt 50 is moved in such a manner that the center C1 of the roller 60 in the axial direction thereof is in agreement with the center line of the endless belt 50 in the width direction thereof.

Here, it is assumed that the endless belt 50 starts to walk for some reason. In this case, for example, in FIG. 13, as the endless belt 50 moves in a W1 direction, the distribution position of the tension of the endless belt 50 applied to the roller 60 is caused to vary, with the result that the tension roller 60 and endless belt 50 are both moved in a broken line position direction. For this reason, the center axis R1 of the tension roller 60 is moved counterclockwise to a center axis R2 and the center position of the endless belt 50 is moved from the center position C1 of the tension roller 60. Finally, the attitude of the tension roller 60 is changed by an angle of α from a normal position 60A thereof shown by a solid line to a position 60B shown by a broken line, while the traveling locus of the endless belt 50 is changed from 50A shown by a solid line to 50B shown by a broken line.

FIG. 14 is an arrow F view of FIG. 12, that is, an explanatory view in which the walk of the endless belt 50 in a plane containing the center axis R3 of the tension roller 60 and the soft axis Y is analyzed.

In FIG. 14, it is now assumed that the tension roller 60 is rotating about the center axis R3 in a position 60*a* shown by a solid line. In this position of the tension roller 60, the endless belt 50 travels along a locus shown by a solid line 50*a*.

Then, it is assumed that the center axis R3 of the tension roller 60 is rotated by an angle of β to a center axis R4 and the position of the tension roller 60 is changed to a position 60*b*. With such position change of the tension roller 60, the endless belt 50 starts to walk in a direction of an arrow W2 shown in FIG. 14, while the locus of the belt 50 is changed to a position shown by a broken line 50*b*.

This relationship between the inclination of the tension roller 60 and the walk of the endless belt 50 on the plane containing the soft axis Y can be confirmed easily by an experiment as well.

The present invention is produced in accordance with the above-mentioned analysis of the relationship between the position change of the tension roller 60 and the movement (walk) of the endless belt 50 in the axial direction of the tension roller 60.

That is, in FIG. 13, when the center axis R1 of the tension roller 60 is inclined counterclockwise and the endless belt 50 starts to walk in the arrow W1 direction, in FIG. 14, the axis of the tension roller 60 is inclined clockwise. Due to this inclination of the tension roller 60, the endless belt 50 is going to start to walk in the arrow W2 direction. Since the two walk directions W1 and W2 of the endless belt 50 are opposite to each other, the walk of the endless belt 50 caused by a difference between the tensions applied to the endless belt 50 in the width side direction thereof can be prevented and corrected.

To control the axis of the above-mentioned tension roller 60, for example, bearings respectively supporting the two ends of the tension roller 60 may be guided along a locus shown by an axis G in FIG. 12. The axis G is an axis which is inclined downwardly in the belt advancing direction at an angle of $\phi$ with respect to the hard axis X.

That is, as shown in FIG. 12, when the position of the tension roller 60 is going to change, the bearing receiving a larger tension is moved along the axis G in a direction of an arrow L shown in FIG. 12. This movement of the bearing, in FIG. 14, causes the axis of the tension roller 60 to incline in a direction shown by an angle $\beta$. That is, this action can correct the walk of the endless belt 50.

Figure 15:
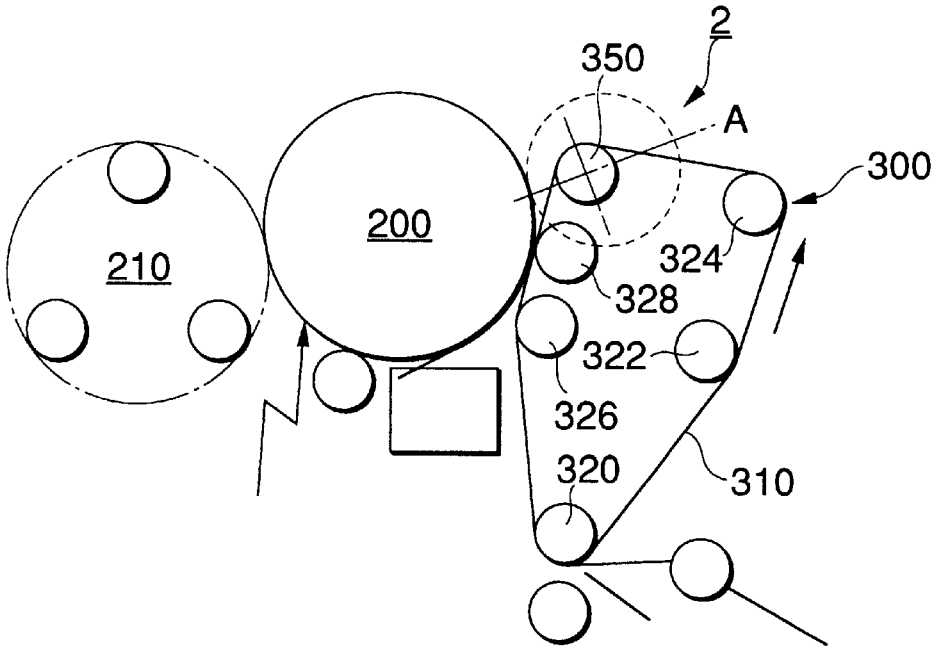
FIG. 15 is an explanatory view of the outline of another image forming apparatus in which the invention is enforced.

Next, FIG. 15 shows an explanatory view of the outline of an image forming apparatus which incorporates therein another embodiment of a belt delivery device according to the invention.

The present image forming apparatus, the whole of which is designated by reference character 2, includes a photoconductor drum 200, a developing unit 210 and a belt delivery device 300 which is used to deliver a recording sheet.

The belt delivery device 300 includes a plurality of rollers 320, 322, 324, 326, 328 and 350, and a belt 310 to be placed around these rollers.

Any one of the rollers 320, 322, 324, 326, 328 and 350 is used as a drive roller and, by driving or rotating the drive roller by use of a motor or the like, the belt 310 can be driven.

Figure 16:
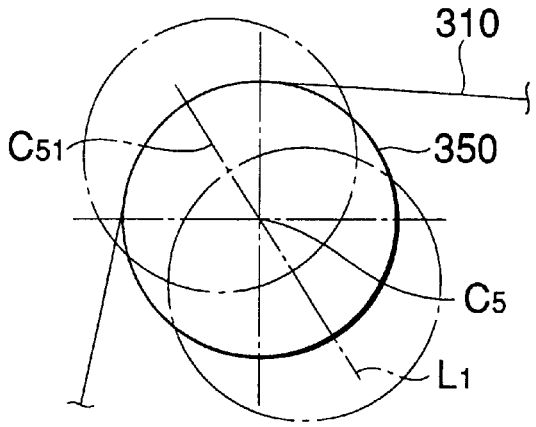
FIG. 16 is an explanatory view of a roller and a belt, showing the moving direction of the rotation center of one end portion of a roller.

Now, FIG. 16 shows the details of the roller 350 shown in the "A" portion of FIG. 15 and, in particular, shows that the roller 350 is moved in such a manner that the rotation center C5 of one end portion of the roller 350 is moved along a line L1 serving as a hard axis.

Figure 17:
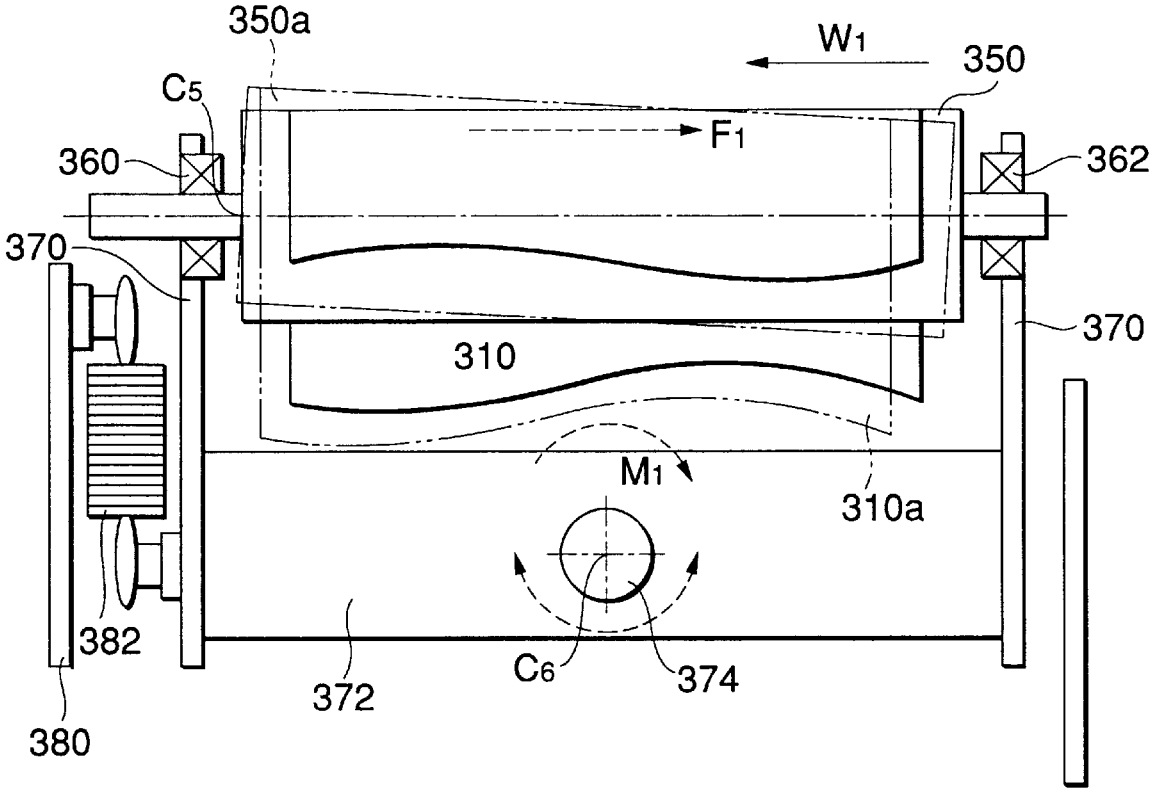
FIG. 17 is an explanatory view of a structure of a displace roller employed in the present belt delivery device.

Next, FIG. 17 is an explanatory view of a support mechanism for supporting the roller 350.

The two end portions of the roller 350 are rotatably supported by a pair of arms 370 through bearings 360 and 362, respectively. The arms 370 are respectively attached to a frame 372, while the central portion of the frame 372 is swingably supported by a shaft 374. The frame 372 is connected to a fixed portion 380 through a spring 382. The spring 382 is not used to drive or swing the frame 372 positively about the shaft 374 but is used to prevent the frame 372 from moving loosely around the shaft 374.

In FIG. 17, it is assumed that the belt 310 placed around the roller 350 produces its walk in a direction of an arrow W1 to thereby start to move from a position shown by a solid line position to a position shown by a broken line position 310*a*.

If the belt 310 starts to move in the arrow W1 direction, then the roller 350 receives a reaction going in the opposite direction (shown by an arrow F1) to the belt moving direction (shown by the arrow W1).

Our experiment shows that the moving speed of the belt 310 is in proportion to the above-mentioned reaction.

If the roller 350 receives a reaction going in the arrow F1 direction, then in the frame 372 supporting the roller 350 there is generated a moment M1 which causes the frame 372 to swing about the shaft 374. Due to the moment M1, the frame 372 and roller 350 are caused to swing about the center axis C6 of the shaft 374. As a result, the position of the roller 350 is changed from the solid line position to the broken line position 350*a*.

This swinging motion of the roller 350 continues until the cause of the generation of the walk of the belt 310 is compensated, while the swinging motion of the roller 350 is stopped at a position where the walk generation cause is compensated.

Therefore, in the stop position of the roller 350, the belt 350 is able to travel along a stable path within the belt delivery device 300.

Figure 18:
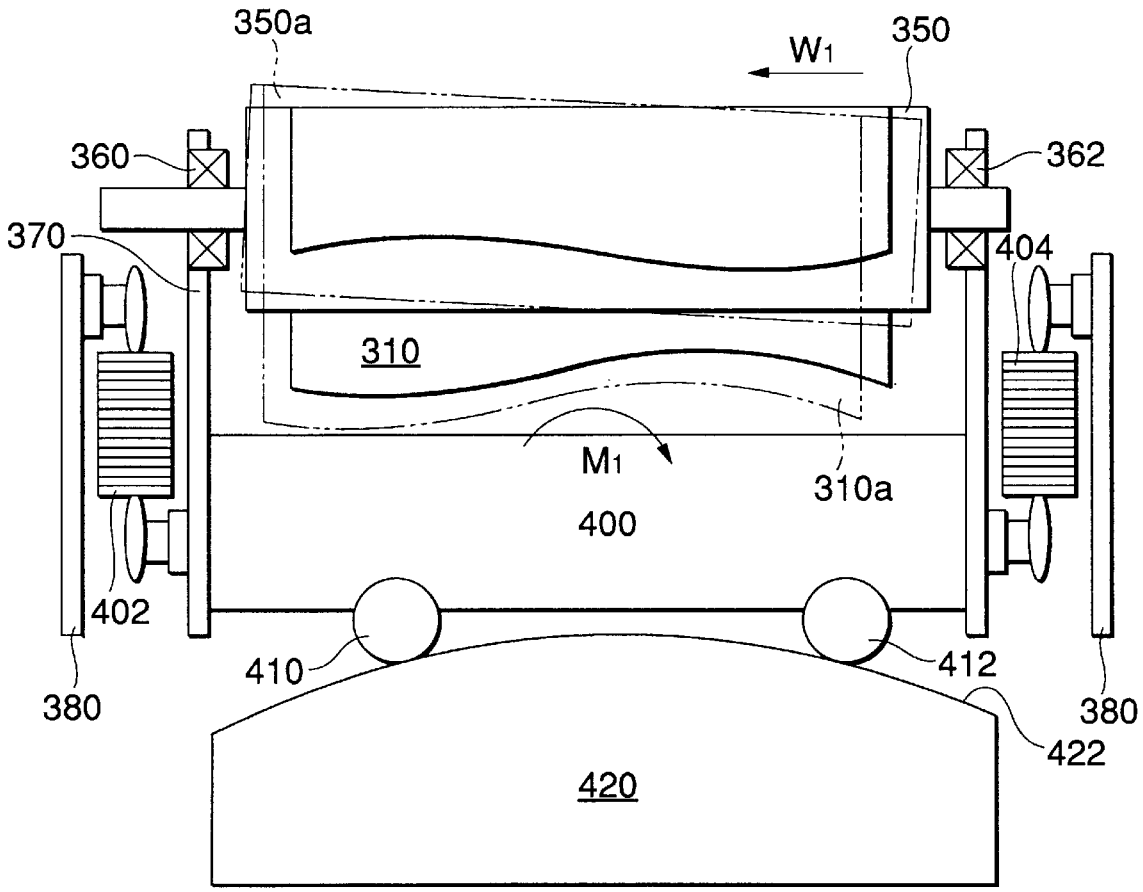
FIG. 18 is an explanatory view of another structure of the displace roller employed in the present belt delivery device; and, FIG. 19 is an explanatory view of still another structure of the displace roller employed in the present belt delivery device.

Now, FIG. 18, similarly to FIG. 17, is a an explanatory view of another embodiment according to the second invention.

A roller 350, around which a belt 310 is placed, is rotatably supported by a pair of arms 370 through bearings 360 and 362, while the arms 370 are respectively attached to a frame 400. The frame 400 is connected to a pair of fixed side members 380 through springs 402 and 404. The springs 402 and 404 respectively have a function to prevent the frame 400 from moving loosely.

The frame 400 includes two rotatable cam followers 410 and 412, while the cam followers 410 and 412 can be respectively moved along the cam surface 422 of a cam member 420. The cam surface 422 has an arc shape which is elevated in the central portion thereof.

If the belt 310 moves in the arrow W1 direction, then the roller 350 receives its reaction, that is, a force to move the roller 350 in the arrow F1 direction is applied to the roller 350. In this case, due to the cam member 420, the frame 400 is caused to move in the arrow F1 direction and, due to the actions of the cam followers 410, 412 and cam surface 422, there is generated a moment M1 which causes the roller 350 and frame 400 to swing.

Owing to the moment M1, the roller 350 is changed from its position shown by a solid line to another position shown by a broken line 350*a*, thereby being able to compensate the cause of the generation of the walk of the belt 310. As a result, the walk of the belt 310 can be stopped and thus the belt 310 can be delivered along a stable path.

Figure 19:
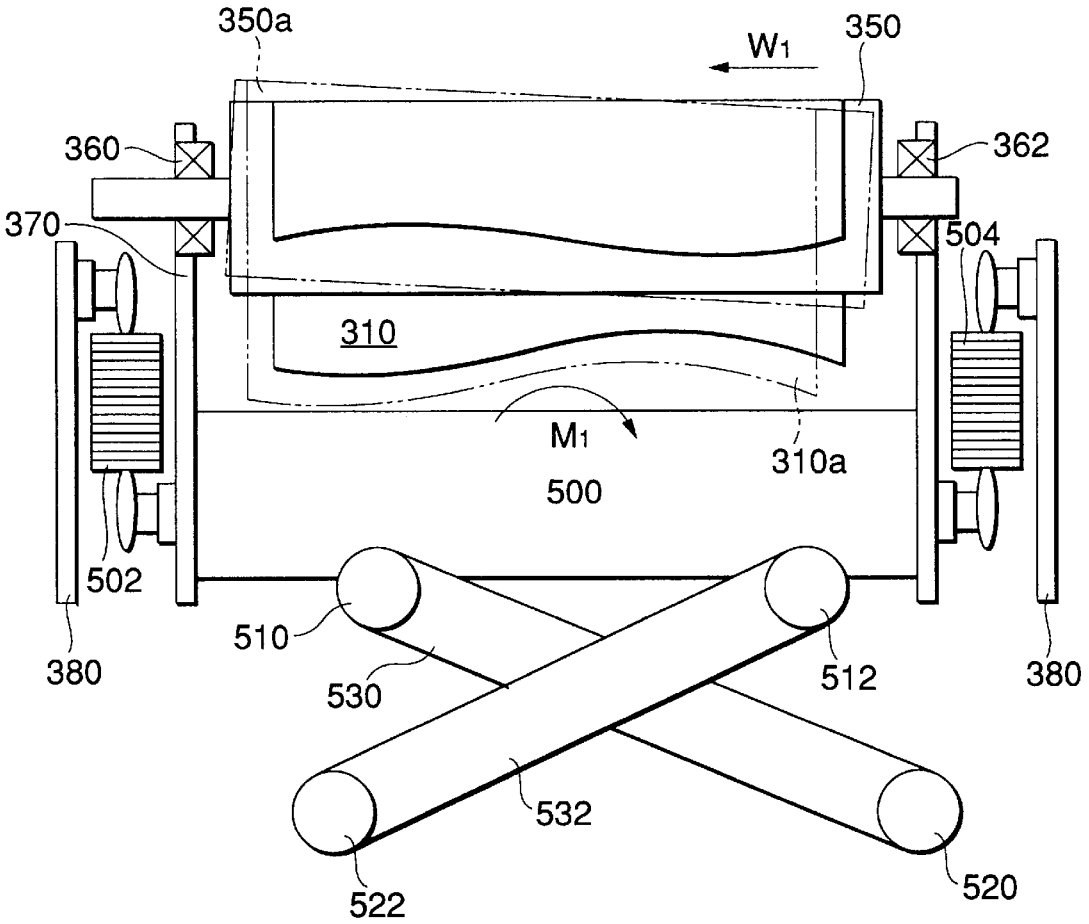

Now, FIG. 19 is, similarly to FIG. 17, an explanatory view of another embodiment according to the invention.

A roller 350, around which a belt 310 is placed, is rotatably supported by a pair of arms 370 through bearings 360 and 362, while the arms 370 are respectively attached to a frame 500. The frame 500 is connected to a pair of fixed side members 380 through springs 502 and 504. The springs 502 and 504 respectively have a function to prevent the frame 400 from moving loosely. The frame 500 includes two pins 510 and 512, while the respective one-side ends of link arms 530 and 532 are rotatably attached to the respective pins 510 and 512. The other ends of the link arms 530 and 532 are rotatably attached to two pins 520 and 522 which are respectively installed on the fixed side of the present apparatus main body.

If the belt 310 moves in a direction of an arrow W1 shown in FIG. 19, then the roller 350 receives its reaction, that is, a force to move the roller 350 in the arrow F1 direction is applied to the roller 350. In this case, due to the link arms 530 and 532, the frame 500 is caused to move in the arrow F1 direction and, due to the actions of the link arms 530 and 532, there is generated a moment M1 which causes the roller 350 and frame 500 to swing.

Owing to the moment M1, the roller 350 is changed from its position shown by a solid line to another position shown by a broken line 350*a*, thereby being able to compensate the cause of the generation of the walk of the belt 310. As a result, the walk of the belt 310 is stopped and thus the belt 310 can be delivered along a stable path.

According to the second invention, as described above, without adding any new mechanisms such as means for detecting the walk of the belt, a roller control mechanism, an actuator and the like to the belt delivery device, the walk of the belt can be prevented or, if any, can be corrected.

Also, the second invention can be applied not only to the tension roller but also to other rollers supporting the endless belt than the tension roller. Further, the present invention can be applied not only to an image forming apparatus but also to all kinds of endless belt delivery devices.

As has been described heretofore, according to the first invention, since the meandering adjusting means are provided for at least two rollers, not only the range of adjustment of the belt meandering can be widened but also there is eliminated the possibility that an unreasonable force can be applied to part of the whole peripheral length of the belt to impair the life of the belt. Also, because the meandering of the endless belt is adjusted by the pressure means which is pressed against the surface of the endless belt on the drive roller, the endless belt meandering can be corrected by a simple structure and there is avoided the possibility that the life of the endless belt can be impaired.

Further, according to the second invention, in the endless belt delivery device for use in the image forming apparatus or the like, a relationship between the displacement of the axis position of one of a plurality of rollers such as a tension roller or the like and the movement of an endless belt in the axial direction of the tension roller is analyzed on an experimental basis to thereby find such direction of displacement of the roller that can prevent the movement of the endless belt in the axial direction thereof.

Such displacement direction of the roller can be realized easily by specifying the direction of a mechanism which guides the movements of the tension roller and the like.

Also, the displacement of the roller is carried out by means of unbalanced tensions in the two shaft end portions of the roller caused by the movement of the endless belt in the axial direction of the roller, which eliminates the need for provision of an actuator for causing the roller to be displaced.

Therefore, with no new mechanism added to the belt delivery device, the endless belt can be driven without generating any walk in the endless belt.

That is, when the present belt delivery device is applied to an image forming apparatus or the like, an image of high quality can be formed.

What is claimed is:

1. An endless belt type delivery device comprising:

a drive roller;

a plurality of driven rollers including a tension apply roller disposed in such a manner that the respective axial directions of the rollers are set parallel to each other;

an endless belt wound around the respective rollers in such a manner that the endless belt can be driven by rotation of the drive roller;

pressure means for pressing against the winding portion of said endless belt around said drive roller in the width direction thereof; and first meandering adjusting means, provided in said pressure means, for biasing the pressure of said pressure means toward the axial-direction end portion of said drive roller.

2. An endless belt type delivery device as set forth in claim 1, wherein said pressure means includes an elastic cleaning blade for cleaning the surface of said endless belt.

3. An endless belt type delivery device as set forth in claim 2, wherein said endless belt and said rollers are installed on a frame and are supported in such a manner that they can be inserted into and taken out from a box-shaped image forming apparatus main body integrally with said frame.

4. An endless belt type delivery device as set forth in claim 2, further comprising:

an inclining mechanism for inclining said rollers with respect to the axial direction thereof, and wherein said cleaning blade constitutes meandering roughly adjusting means and said inclining mechanism constitutes meandering finely adjusting means.

5. An endless belt type delivery device as set forth in claim 1, further comprising second meandering adjusting means provided in at least two of said rollers, for biasing contact pressures between said rollers and said endless belt toward the axial-direction end portion of said rollers.

6. An endless belt type delivery device as set forth in claim 5, wherein said first meandering adjusting means includes meandering roughly adjusting means and said second meandering adjusting means includes meandering finely adjusting means.

7. An endless belt type delivery device as set forth in claim 5, wherein said second meandering adjusting means includes an inclining mechanism for inclining said rollers with respect to the axial direction thereof.

8. An endless belt type delivery device as set forth in claim 7, wherein said inclining mechanism includes inclining shafts in two end portions of said rollers.

9. An endless belt type delivery device as set forth in claim 5, wherein said first meandering adjusting means includes an elastic cleaning blade for cleaning the surface of said belt and said second meandering adjusting means is inclinable relative to the moving direction of said endless belt.

10. An endless belt type delivery device comprising:

a drive roller;

a plurality of driven rollers including a tension apply roller disposed in such a manner that the respective axial directions of the rollers are set parallel to each other;

an endless belt wound around the respective rollers in such a manner that the endless belt can be driven by rotation of the drive roller;

meandering adjusting means, provided in at least two of said rollers, for biasing contact pressures between said rollers and said endless belt toward the axial-direction end portion of said rollers; and pressure means for pressing against the winding portion of said endless belt around said drive roller in the width direction thereof, and wherein said meandering adjusting means is provided in said pressure means, and biases the pressure of said pressure means toward the axial-direction end portion of said drive roller.

11. A belt delivery device comprising:

an endless belt;

a plurality of rotary rollers around which the endless belt is wound;

at least one drive roller included in the plurality of rotary rollers for driving the endless belt; and at least one tension roller included in the plurality of rotary rollers for applying a tension to the endless belt, wherein at least one of said plurality of rotary rollers is a displacement roller which is displaced as said endless belt is moved in the axial direction of said roller; and wherein, when said endless belt is moved axially toward one end side of said displacement roller, said displacement roller is displaced in such a manner that the one end side of said displacement roller is displaced relatively downstream with respect to a bisector of an angle at which said endless belt is lapped on said displacement roller, while the other end side of said displacement roller is displaced relatively upstream with respect to said bisector.

12. A belt delivery device as set forth in claim 11, wherein said displacement roller is displaced in such a manner that the side of said displacement roller toward which said endless belt is moved is displaced in a direction in which the tension of said endless belt increases.

13. A belt delivery device as set forth in claim 11, wherein said displacement of said displacement roller is carried out by the moving reaction of said endless belt applied to said displacement roller when said endless belt is moved in the axial direction of said displacement roller.

14. A belt delivery device as set forth in claim 11, wherein said displacement roller is a tension roller.

15. A belt delivery device as set forth in claim 11, wherein said displacement of said displacement roller is carried out by the unbalanced belt tensions applied to the two end portions of said displacement roller when said endless belt is moved in the axial direction of said displacement roller.

16. A belt delivery device as set forth in claim 11, wherein said endless belt is a photoconductive body of an image forming apparatus.

17. A belt delivery device as set forth in claim 11, wherein said endless belt is an intermediate transfer body of an image forming apparatus.

18. A belt delivery device as set forth in claim 11, wherein said endless belt is a transfer sheet carrier body of an image forming apparatus.

19. An endless belt type delivery device comprising:

a drive roller;

a plurality of driven rollers including a tension apply roller disposed in such a manner that the respective axial directions of the rollers are set parallel to each other;

an endless belt wound around said respective rollers in such a manner that the endless belt can be driven by rotation of said drive roller;

a blade adjustably fixed relative to said endless belt and kept in axially-biased pressure-contact with a portion of said endless belt that is lapped around said respective rollers.

20. An endless belt type delivery device according to claim 19, wherein at least one of said driven rollers is inclinable relative to said endless belt.

21. An endless belt type delivery device according to claim 20, wherein at least one of said drive rollers is inclinable in such a direction that one end side of said at least one driven roller is displaced relatively downstream with respect to a bisector of an angle at which said endless belt is lapped on said at least one driven roller, while the other end of said at least one driven roller is displaced relatively upstream with respect to said bisector.

* * * * *